US005967016A

United States Patent [19]

Simonds

[11] Patent Number: 5,967,016

[45] **Date of Patent: *Oct. 19, 1999**

[54] ANTI-BACKLASH SPRAG

[75] Inventor: Edward L. Simonds, Adel, Iowa

[73] Assignee: Thermal Dynamics, Inc., Adel, Iowa

[ * ] Notice: This patent is subject to a terminal disclaimer.

[21] Appl. No.: 08/800,838

[22] Filed: Feb. 14, 1997

[51] Int. Cl.[6] ..... F01L 33/02

[52] U.S. Cl. ..... 91/180; 60/441; 192/41 A

[58] Field of Search ..... 91/469, 470, 523, 91/180, 218, 536, 466; 60/370, 483, 484, 441, 435; 74/128; 137/625.23, 625.24, 625.13; 192/41 A

[56] References Cited

U.S. PATENT DOCUMENTS

| | | | |
|---|---|---|---|
| 1,115,470 | 10/1914 | Lipman | 91/180 |
| 1,291,642 | 1/1919 | Elwell . | |
| 3,038,311 | 6/1962 | Linsley et al. . | |
| 3,938,426 | 2/1976 | Hunter | 92/140 |
| 4,986,402 | 1/1991 | Neuwirth et al. | 192/41 A |
| 5,484,272 | 1/1996 | Horn . | |

FOREIGN PATENT DOCUMENTS 2 347 753 9/1972 Germany .

*Primary Examiner*—F. Daniel Lopez

[57] ABSTRACT

A drive shaft assembly is provided for allowing rotation of a drive shaft in a single direction. The drive shaft assembly includes a housing, a drive shaft and an overrunning clutch. The overrunning clutch includes an inner race having an outer annular contact surface and an outer race having an inner annular contact surface spaced radially from the inner race. The inner annular contact surface and the outer annular contact surface form an annular space therebetween. Provided within this annular space are a plurality of sprags which allow the inner race to rotate in a first direction relative to the outer race while preventing the inner race from rotating in a second direction to the outer race. A drive housing is secured to the outer race and a drive shaft is secured to the inner race so that when rotational force is provided to the drive shaft in the first direction, the drive shaft rotates, but when force is applied to rotate the drive shaft in the reverse direction, the torsional forces on the drive shaft are transferred through the overrunning clutch to the housing thereby preventing rotation of the drive shaft in the second direction. In the preferred embodiment, the drive shaft is coupled to a piston assembly which transfers linear actuation of the piston to rotational movement of the drive shaft.

8 Claims, 5 Drawing Sheets

12
16
92
34
32
44
26
42
24
18
14
20
90
28
30
40
38
36
46
88
61
54
52
94
110
100
114
116
60
62
64
74
70
106
68
72
102
112
96
78
66
76
98
104
80
108
50

ANTI-BACKLASH SPRAG

BACKGROUND OF THE INVENTION

1. Field of the Invention

The invention relates in general to a drive shaft assembly and, more particularly, to a drive shaft assembly which prevents backlash and reverse rotation of the drive shaft.

2. Description of the Prior Art

In the prior art, it is known to mechanically couple a piston to rotate a drive shaft. In typical internal combustion piston-type devices, a crank shaft is used to transfer linear motion of the piston to rotational motion of the crank shaft. The operation of a crank shaft, however, requires that a plurality of pistons be coupled to a single crank shaft to completely rotate the crank shaft.

By adding a plurality of piston assemblies, both initial costs and maintenance costs are increased. Additionally, it is much more likely that one of a plurality of pistons will fail, than it is that a single piston, by itself, would fail.

Accordingly, it would be desirable to provide means for converting linear motion to rotational motion without the need for a plurality of pistons. The difficulties encountered in the prior art discussed hereinabove are substantially eliminated by the present invention.

SUMMARY OF THE INVENTION

The present invention is a drive shaft assembly having a housing, a drive shaft and an overrunning clutch assembly. The overrunning clutch assembly has an inner race having an outer annular contact surface and an outer race having an inner annular contact surface. The inner annular contact surface and the outer annular contact surface form an annular space therebetween. The overrunning clutch assembly also has a plurality of sprags provided in the annular space, wherein the plurality of sprags allow the inner race to rotate in a first direction relative to the outer race, while preventing the inner race from rotating in a second direction relative to the outer race. The overrunning clutch assembly also is provided with means for maintaining the plurality of sprags in the annular space. In the drive shaft assembly of the present invention, the housing is secured to the outer race and the drive shaft is secured to the inner race.

In the preferred embodiment of the present invention, a piston and swing arm assembly is secured to the drive shaft to rotate the drive shaft in a first direction. The overrunning clutch secured to the housing prevents reverse rotation of the drive shaft to assure that the drive shaft is driven in only a single direction.

DETAILED DESCRIPTION OF THE PREFERRED EMBODIMENT

Figure 1:
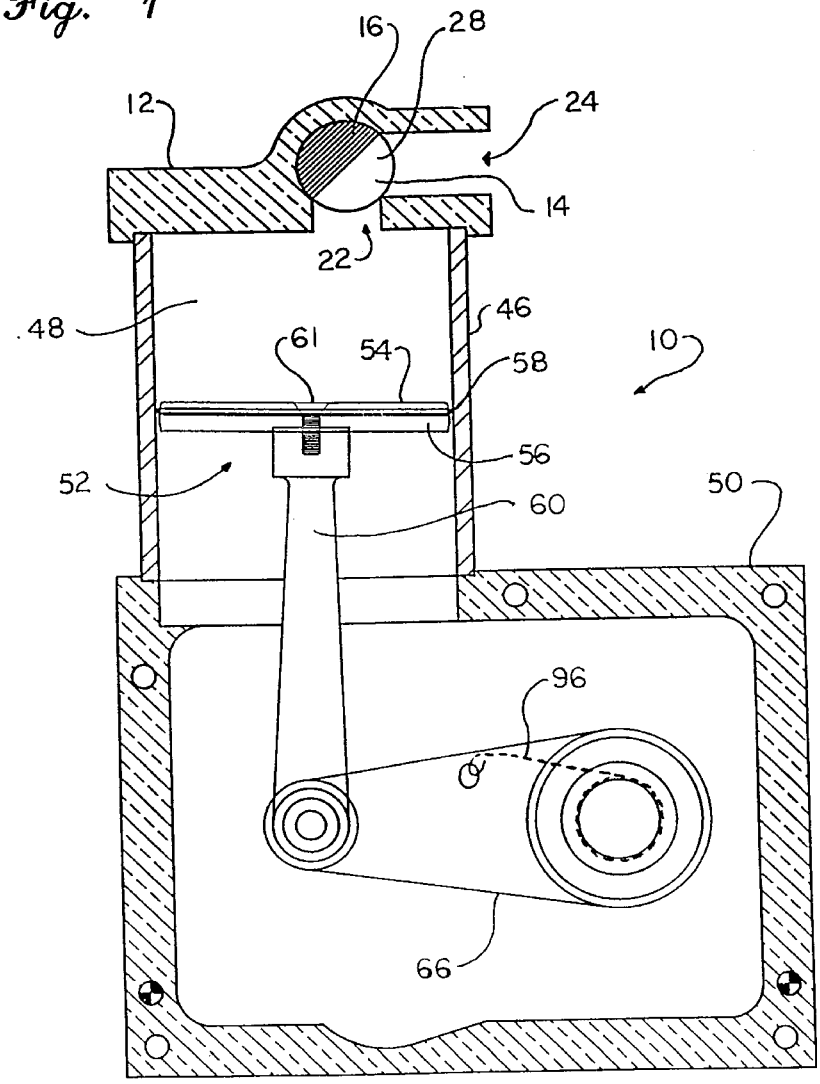
FIG. 1 is a side elevation in cross-section showing the valve assembly and piston assembly of the present invention.
Figure 3:
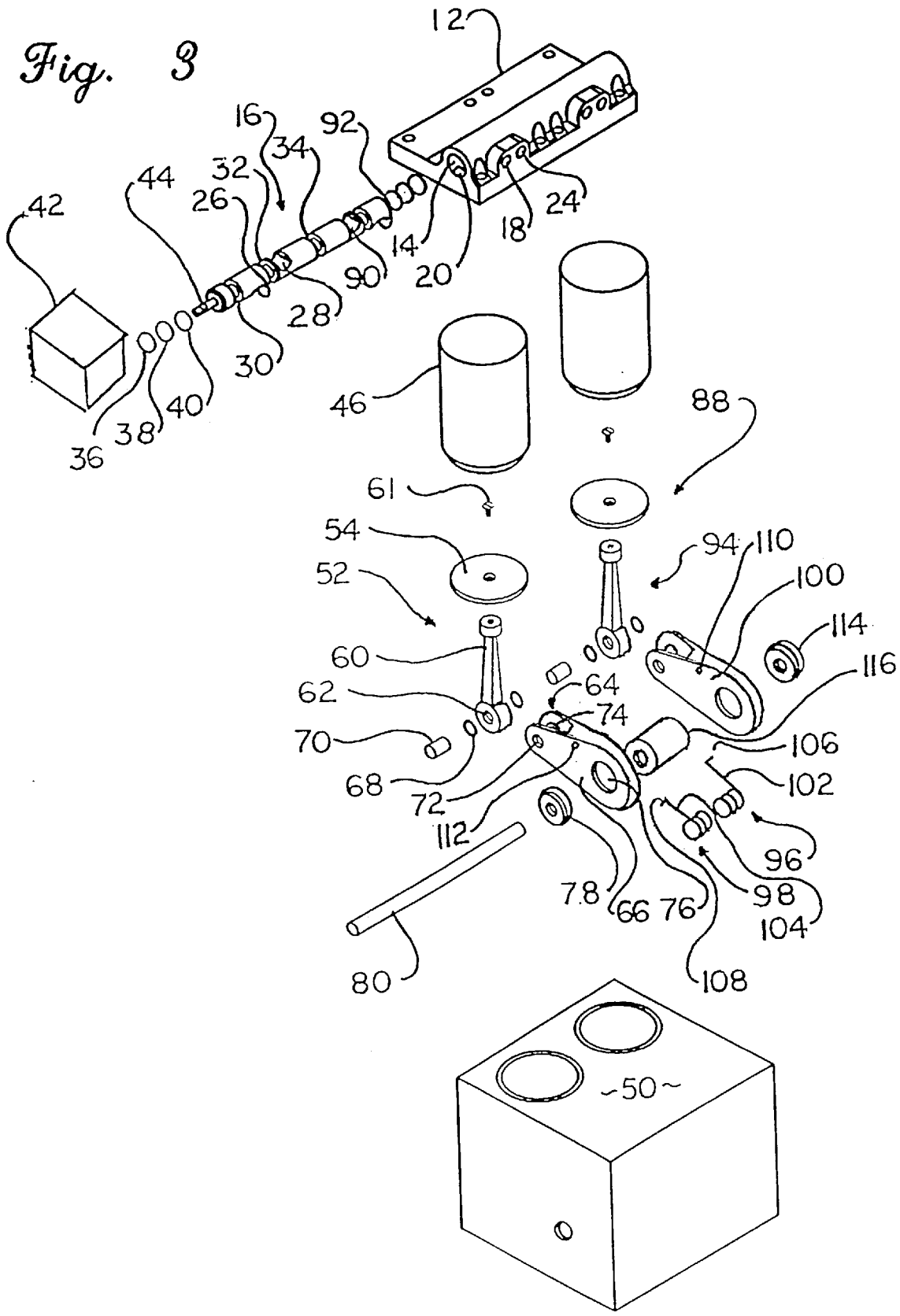
FIG. 3 is an exploded view of the valve assembly and piston assembly of FIG. 2.

With reference to the drawings, a variable stroke motor is indicated generally as 10 in FIG. 1. As shown in FIG. 3, the variable stroke motor includes a valve housing 12. In the preferred embodiment, the valve housing 12 is constructed of aluminum and provided with a hollow cylinder 14 to accommodate a valve shaft 16. The valve housing 12 is constructed to form a first fluid input 18 in fluid communication with the hollow cylinder 14 and a first fluid output 20 which is also in fluid communication with the hollow cylinder 14. As shown in FIG. 1, the valve housing 12 is also formed with a second fluid input 22 and a second fluid output 24.

As shown in FIG. 3, the valve shaft 16 is provided with a first slot 26 and a second slot 28. The valve shaft 16 is also provided with a first ring seat 30, a second ring seat 32, and a third ring seat 34. Provided on the first ring seat 30, second ring seat 32, and third ring seat 34 are three teflon rings 36, 38 and 40 which prevent the escape of fluid between the valve shaft 16 and hollow cylinder 14.

Figure 2:
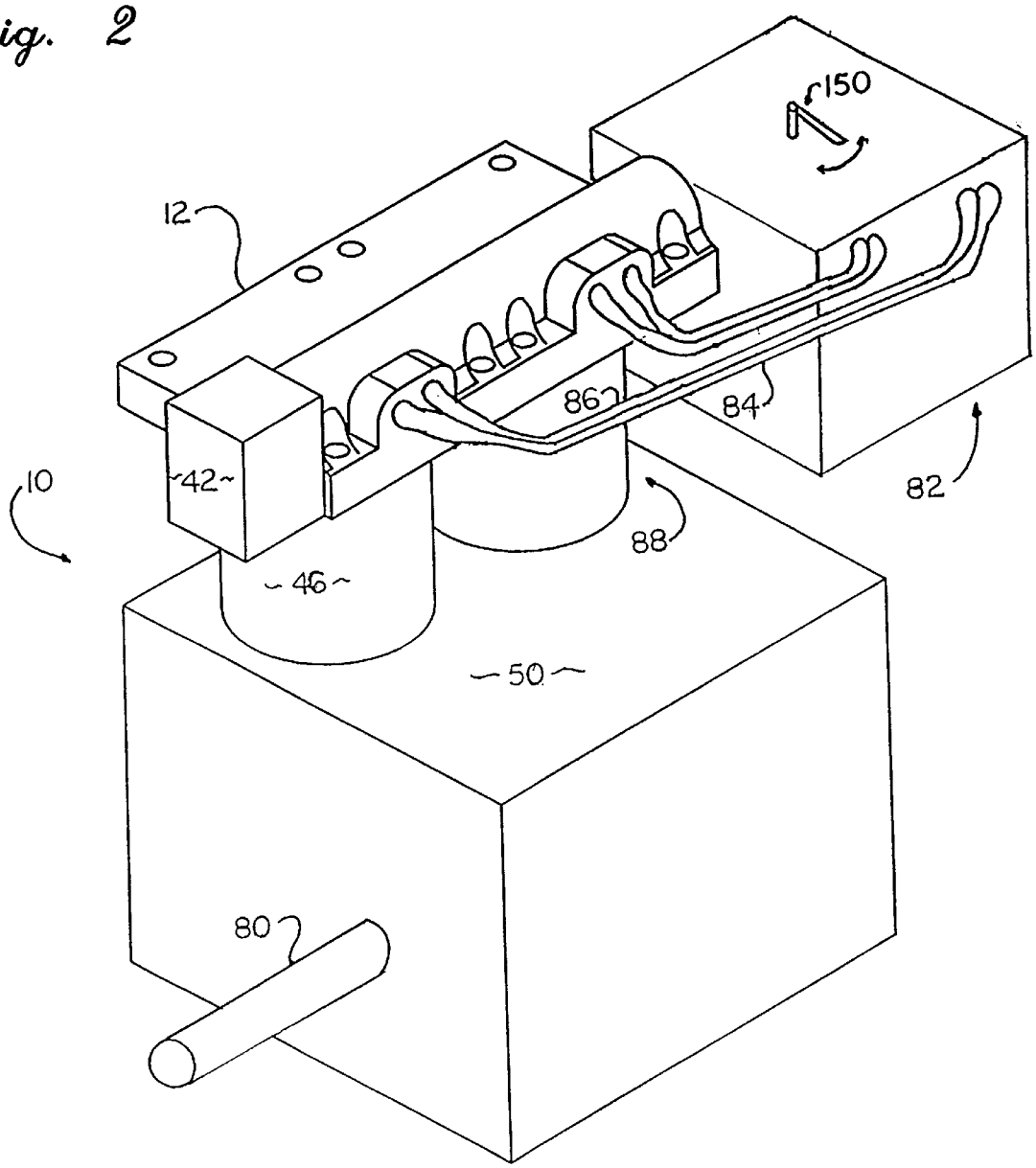
FIG. 2 is a perspective view of the valve assembly and piston assembly of FIG. 1.

As shown in FIG. 2, secured to the valve housing 12 is a shaft rotator 42 which is operably secured to the key 44 extending from the valve shaft 16 shown in FIG. 3. The shaft rotator 42 may be a small electric motor or any similar rotation device known in the art.

As shown in FIG. 3, the first slot 26 and second slot 28 of the valve shaft 16 are disposed on opposite sides of the valve shaft 16. Accordingly, when the valve shaft 16 is positioned within the hollow cylinder 14 of the valve housing 12, as shown in FIG. 1, the second slot 28 opens fluid communication between the second fluid input 22 and the second fluid output 24. When the second slot 28 opens fluid communication between the second fluid input 22 and second fluid output 24, as shown in FIG. 1, the first slot 26 is completely covered by the valve housing 12 (FIGS. 1 and 3). The portion of the valve shaft 16 on the opposite side of the first slot 26, therefore, seals off fluid communication between the first fluid input 18 and first fluid output 20.

Similarly, when the shaft rotator 42 rotates the valve shaft 16 one hundred and eighty degrees, the first slot 26 opens fluid communication between the first fluid input 18 and first fluid output 20, while the portion of the valve shaft 16 opposite the second slot 28 seals off fluid communication between the second fluid input 22 and second fluid output 28. In the preferred embodiment, the slots 26 and 28 and the inputs 18 and 22 and the outputs 20 and 24 are sized so that when the fluid communication between the first fluid input 18 and first fluid output 20 is open, fluid communication between the second fluid input 22 and second fluid output 24 is closed. Similarly, when fluid communication between the second fluid input 22 and second fluid output 24 is open, fluid communication between the first fluid input 18 and first fluid output 20 is closed.

Secured to the valve housing 12 is a drive housing 46 which forms a drive cylinder 48 as shown in FIG. 1. In the preferred embodiment, the drive housing 46 is constructed of stainless steel seamless tubing. Preferably, the drive housing 46 is secured to a drive box 50 which, is preferably constructed of aluminum. Provided within the drive cylinder 48 is a piston 52. The piston 52 is preferably constructed with an aluminum cap 54 and an aluminum base 56. As the piston 52 is of a wobble-type, the piston 52 is provided with a plastic sealing ring 58 which allows the piston 52 to pivot two degrees from a position normal to the center axis of the drive cylinder 48, while maintaining a seal between the sealing ring 58 and the drive housing 46.

A piston rod 60 preferably constructed of hardened steel is secured to the piston 52 with a securement screw 61 (FIG. 1). As shown in FIG. 3, the piston rod 60 is provided with an eyelet 62 which fits within a yoke 64 of a swing arm 66. Provided within the eyelet 62 is a needle roller bearing 68 or similar bearing known in the art to reduce friction. The needle roller bearing 68 is positioned within the eyelet 62, the eyelet 62 positioned within the yoke 64 and a dowel pin 70 constructed of heat treated steel is positioned through a first eyelet 72 of the yoke 64, the needle roller bearing 68, and a second eyelet 74 of the yoke 64. The dowel pin is preferably constructed of heat treated steel to withstand the large pressures associated with actuation of the piston rod 60. The swing arm 66 is preferably constructed of hardened steel and is provided with a large hole 76 to accommodate a pair of drive sprags 78. The drive sprags 78 are coupled to a drive shaft 80 in a manner which transfers rotational energy from the swing arm 66 to the drive shaft 80 on the drive stroke and which allows the drive shaft 80 to "free-wheel" relative to the swing arm 66 on the recovery stroke so that the drive shaft 80 is not rotated in the opposite direction. As shown in FIG. 2, the drive shaft 80 extends through the drive box 50 to power a vehicle or any other drivable device.

Operably coupled in fluid communication with the first fluid input 18, is a fluid pressure generator 82 (FIG. 2). In the preferred embodiment, the pressure generator 82 is a steam generator, but the pressure generator 82 may, of course, be any similar device. The fluid pressure generator 82 is coupled to the first fluid input 18 via a transfer hose 84 (FIGS. 2 and 3). In the preferred embodiment, the second fluid output 24 is also coupled to the fluid pressure generator 82 by a supplemental transfer hose 86.

As shown in FIG. 2, the variable stroke motor 10 is also provided with a supplemental valve and piston assembly 88. The supplemental valve and piston assembly 88 is substantially similar in design to the assembly described above. As shown in FIG. 3, however, the valve shaft 16 is provided with a third slot 90 and a fourth slot 92 positioned on the valve shaft 16 in reverse of the positions of the first slot 26 and second slot 28. This positioning of the slots 26, 28, 90 and 92 causes the piston 52, described above, to drive when the piston 94 of the supplemental valve and piston assembly 88 is recovering, and to recover when the piston 94 of the supplemental valve and piston assembly 88 is driving. This complimentary actuation of the pistons 52 and 94 causes the drive shaft 80 to be substantially continuously driven by one of the two pistons 52 and 94.

Figure 4:
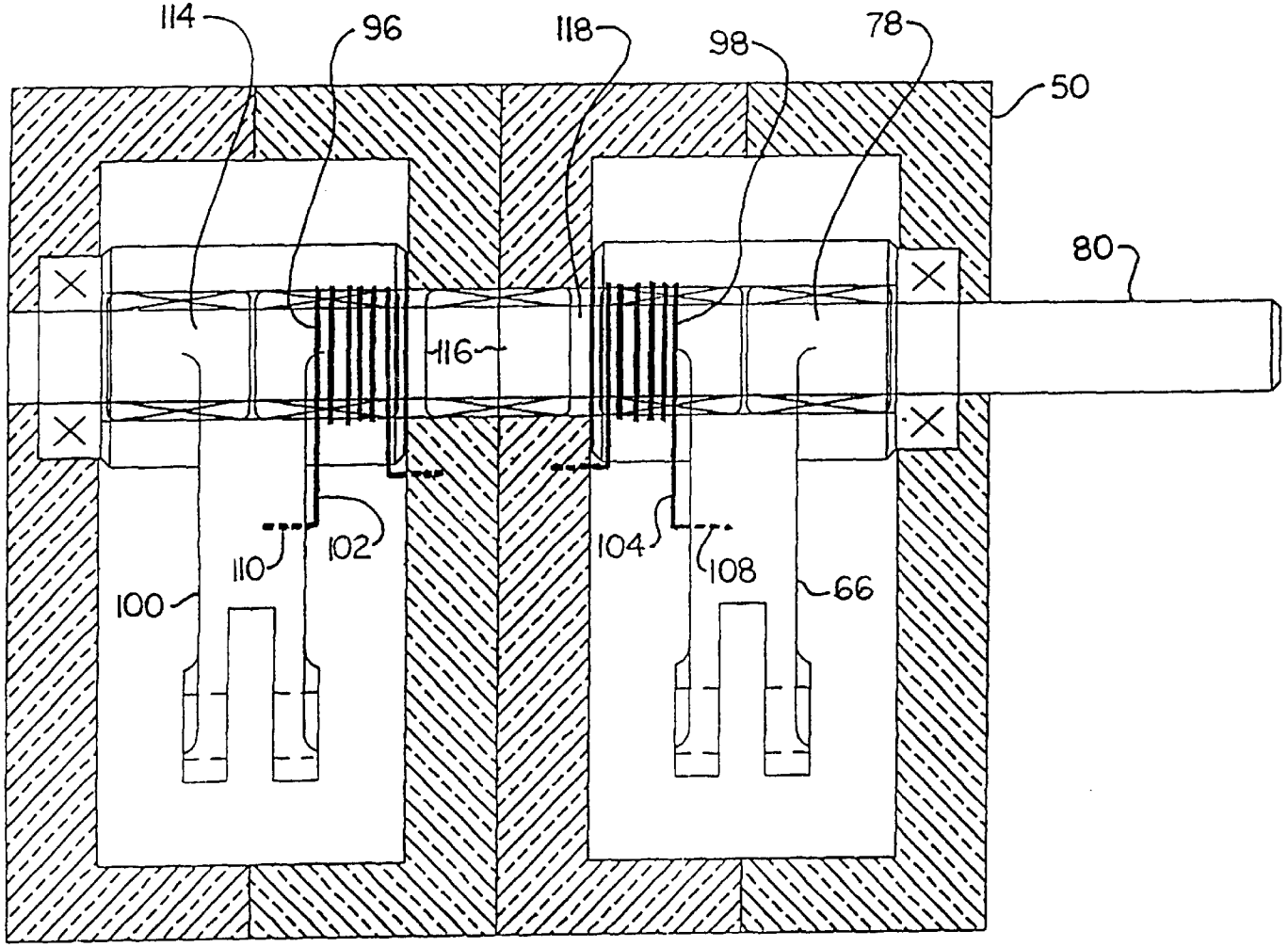
FIG. 4 is a top view in cross-section showing the arms and shaft assembly of FIG. 1.

As shown in FIG. 4, two recovery springs 96 and 98 are provided to return the swing arm 66, described above, and the swing arm 100 of the supplemental valve and piston assembly 88 to a starting position. As each swing arm 66 and 100 alternately moves to a starting position, the swing arms 66 and 100 move their respective pistons 52 and 94 to a starting position as well. The recovery springs 96 and 98 are secured to the drive box 50 around the drive shaft 80. Each recovery spring 96 and 98 is provided with a recovery arm 102 and 104 and a securement finger 106 and 108. Once the recovery springs 96 and 98 are secured to the drive box 50, the fingers 106 and 108 are positioned within holes 110 and 112 provided in the swing arms 66 and 100. As shown in FIG. 4, the drive shaft 80, is coupled to the interior perimeters of a pair of drive sprags 114 which, in turn, are coupled on their exterior perimeters to the swing arm 100. The drive sprags 114 are oriented so that as the swing arm 100 is driven by the piston 94, the drive sprags 114 transfer the rotational motion of the swing arm 100 to the drive shaft 80. During the recovery stroke, the drive sprags 114 "freewheel" to allow the recovery spring 96 to return the swing arm 100 to its starting position without transferring a large amount of rotational energy to the drive shaft 80.

An anti-backlash sprag 116 is secured to the drive shaft 80 between the swing arms 66 and 100 to further reduce the transfer of rotational energy between the swing arms 66 and 100 and the drive shaft 80. As shown in FIG. 4, the anti-backlash sprag 116 is secured to the drive box 50 within a drive shaft opening 118 provided in the drive box 50 between the swing arms 66 and 100. The anti-backlash sprag 116 is secured to the drive box 50 by weldments or other similar securement means. The anti-backlash sprag 116 is similar in construction to the drive sprags 114, but is coupled to the drive shaft 80 in an opposite operational orientation relative to the drive sprags 114. Accordingly, when the swing arm 100 is in its drive stroke, the drive sprags 114 transfer rotational energy of the swing arm 100 to the drive shaft 80. During this drive stroke, the anti-backlash sprag 116 is in its "freewheel" orientation, allowing the drive shaft 80 to rotate freely. Once the swing arm 100 has finished its drive stroke, the recovery spring 96 returns the swing arm 100 to its starting position. As the recovery spring 96 rotates the swing arm 100, the drive sprags 114 are in their "freewheel" orientation which limits rotational energy transfer from the swing arm 100 to the drive shaft 80 and reduces the drag on the recovery spring 96.

Figure 5:
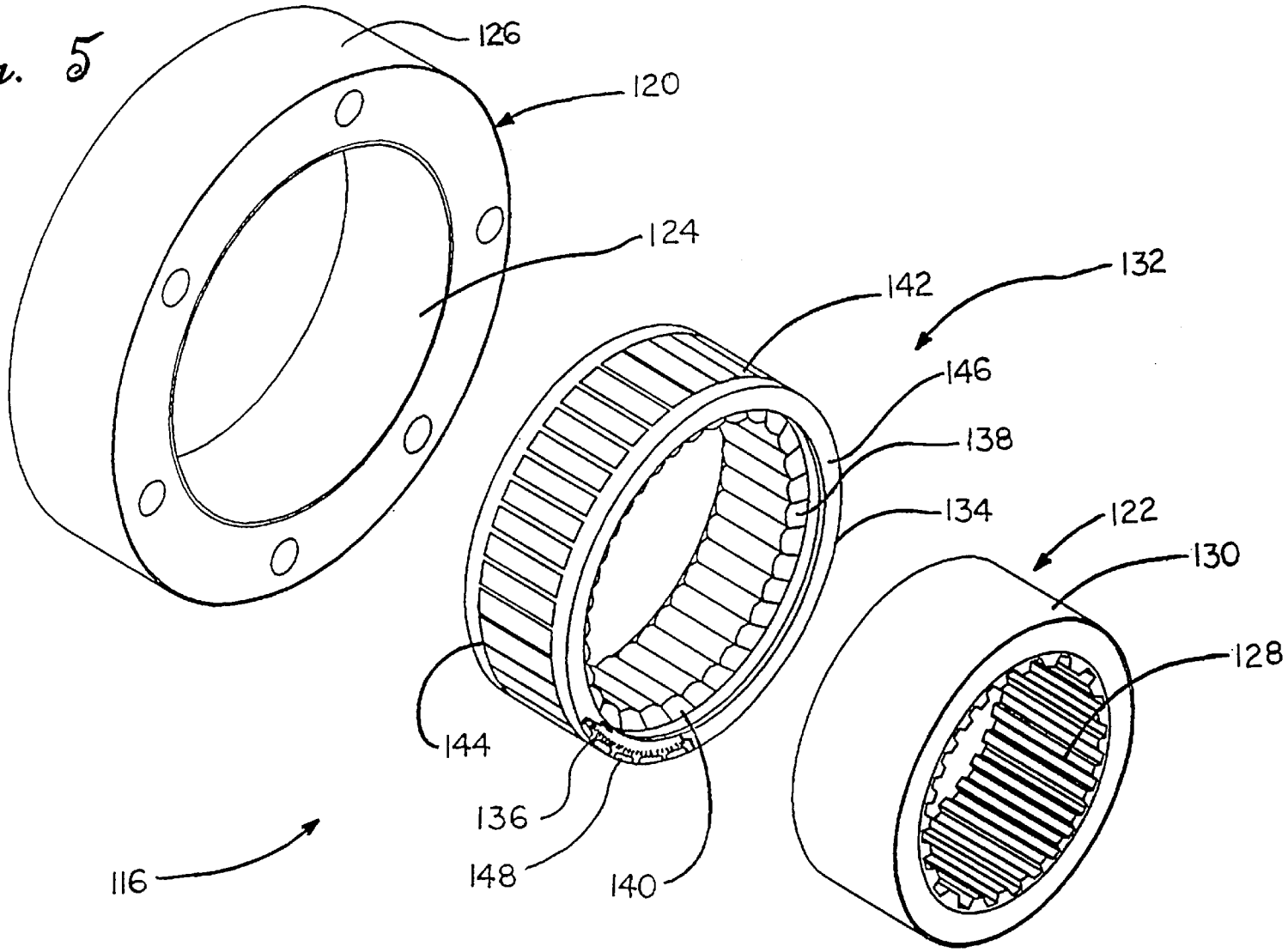
FIG. 5 is an exploded view in partial cut-away of the overrunning clutch assembly of the present invention.

As shown in FIG. 5, the anti-backlash sprag 116 is provided with an outer race 120 and an inner race 122. Both the outer race 120 and inner race 122 are preferably constructed of hardened steel to increase the longevity of the anti-backlash sprag 116. The outer race 120 is provided with inner annular contact surface 124. The outer race 120 is also provided with an exterior surface 126 which is welded or otherwise secured to the drive housing 50 as shown (FIGS. 4 and 5). As shown in FIG. 5, the inner race 122 may be provided with a keyed inner annular surface 128 for connection to the drive shaft 80 which may or may not be provided with a similar keyed surface (not shown) to facilitate transfer of torque from the drive shaft 80 to the inner race 122. The inner race 122 is also provided with an outer annular contact surface 130.

Provided between the outer race 120 and the inner race 122 is a sprag assembly 132 (FIG. 5). As shown in FIG. 5, the sprag assembly 132 comprises a sprag retainer 134, a pair of coil springs 136 and a plurality of sprags 138. When the sprag assembly 132 is removed from the anti-backlash sprag 116, the coil springs 136 bias the sprags 138 into an upright position. When the sprags 138 are in their upright position, however, there is not sufficient distance between the outer race 120 and the inner race 122 to insert the sprag assembly 122 therebetween. Accordingly, the sprags 138 must be tilted slightly to allow assembly of the anti-backlash sprag 116. The sprags 138 are each preferably provided with a body 140 to contact the outer annular contact surface 130 of the inner race 122 and a head 142 to contact the inner annular contact surface 124 of the outer race 120. Preferably, the bodies 140 are slightly wider and shorter than both the heads 142 and openings 144 provided in the sprag retainer 122. The width of the bodies 140 prevents the sprags 138 from falling out of the sprag retainer 134. The length of the bodies 140 provides sufficient clearance for placement of the coil springs 136 between the bodies 140 and sidewalls 146 of the sprag retainer 134. Because the bodies 140 are shorter than the heads 142, the coil springs 136 are able to bias an overhanging portion 148 of the heads 142 outward, thereby biasing the sprags 138 into their upright position.

When the anti-backlash sprag 116 is fully assembled, the sprag assembly 132 is placed within the outer race 124, and the inner race 122 is placed within the sprag assembly 132 (FIGS. 4 and 5). The inner race 122 is thereby allowed to rotate in a first direction (counterclockwise as shown) relative to the outer race 120, because this rotation tilts the sprags 138 away from their upright position. Conversely, the anti-backlash sprag 116 prevents rotation of the inner race 122 in the opposite direction (clockwise as shown) relative to the outer race 120, as this rotation allows the sprags 138 to tilt toward their upright position, thereby wedging the sprags 138 between the inner race 14 and the outer race 120. Accordingly, the drive shaft 80, which is secured to the inner race 14, is free to rotate in a counterclockwise direction relative to the anti-backlash sprag 116 as such rotation tilts the sprags 138 away from their upright position. Conversely, if attempts are made to rotate the drive shaft in a clockwise direction, the coil springs 136 bias the sprags 138 toward their upright position, thereby transferring torsional forces of the inner race 122 to the outer race 120. Because the outer race 120 is welded to the drive box 50, rotation of the drive shaft 80 in a clockwise direction is prevented by the anti-backlash sprag 116.

The anti-backlash sprag 116 is provided to prevent any further rotation of the drive shaft 80 in the direction of the swing arm 100 recovery. If the friction between the drive sprags 114 and drive shaft 80 is great enough to transfer some amount of rotational energy from the drive sprags 114 to the drive shaft 80 during the recovery stroke of the swing arm 100, the anti-backlash sprag 116 prevents rotation of the drive shaft 80. Since the anti-backlash sprag 116 is welded to the drive box 50, the anti-backlash sprag 116 transfers any "backward" rotational energy of the drive shaft 80 to the drive box 50 to prevent rotation of the drive shaft 80 in the direction of the swing arm 100 recovery.

The anti-backlash sprag 116 continues to prevent backward rotation of the drive shaft 80 until one of the swing arms 66 or 100 begins rotating the drive shaft 80 on the drive stroke. In this way, the anti-backlash sprag 116, assures that the drive shaft 80 is rotated in only a single direction.

To operate the variable stroke motor 10 of the present invention, the shaft rotator 42 is actuated to rotate the valve shaft 16 within the hollow cylinder 14. The fluid pressure generator 82 is then actuated to supply a pressurized fluid, such as steam, to the first fluid input 18 and to the supplemental valve and piston assembly 88. The valve shaft 16 is thereby being rotated at a constant speed. When fluid is being applied at a low pressure to the first fluid input 18, only a small amount of fluid enters the drive cylinder 58 as the first slot 26 opens fluid communication between the first fluid input 18 and first fluid output 20. This introduction of fluid into the drive cylinder 48 forces the piston 52 away from the valve housing 12. As the swing arm 66 rotates, the eyelet 62 of the piston rod 60 pivots slightly as the swing arm 66 reciprocates. This pivoting of the piston rod 60 causes the entire piston 52 to tilt slightly relative to the drive cylinder 48. To reduce the amount of tilt, the piston 52 is arranged so that in both its starting position and its ending position the piston 52 is slightly tilted. This reduces the degree of tilt of the piston 52 when the piston is at the center of a full stroke. The swing arm 66 and piston rod 60 are preferably designed with lengths sufficient to place the piston 52 in a starting position wherein the piston 52 is tilted two degrees from normal, relative to the center axis of the drive cylinder 48.

To examine how the piston 52 tilts, it is desirable to examine a full stroke of the piston 52, that is, when fluid is being applied to the first fluid input 18 at full pressure. As the drive cylinder 48 begins to fill with fluid the piston 52 moves toward the swing arm 66 causing the piston 52 to move away from the valve housing 12, thereby pushing the swing arm 66 which begins to rotate. As the swing arm 66 rotates, the piston rod 60 pivots within the yoke 64 of the swing arm 66. The piston 52 continues to rotate until the piston 52 becomes normal to the center axis of the drive cylinder 48. This occurs when the piston 52 is one-quarter of the way through the full stroke of the piston 52.

As more fluid enters the drive cylinder 48, the piston 52 continues to pivot away from the drive shaft 80 until the piston 52 is halfway through its full stroke as shown in FIG. 1. At this point, the piston 52 is two degrees from normal relative to the axis of the drive cylinder 48, but in a direction opposite the two degree orientation of the starting point. As the drive cylinder 48 continues to fill with fluid, the swing arm 66 rotates further, until the piston 52 is three-quarters of the way through its full stroke. At this point the swing arm 66 has rotated sufficiently so that the piston 52 is again normal to the center axis of the drive cylinder 48. As the drive cylinder 48 continues to fill with fluid, the swing arm 66 continues to rotate, and the piston 52 moves toward a position two degrees from normal relative to the center axis of the drive cylinder 48. This two degree tilt is in the same direction as the two degree from normal orientation of the piston 52 at the starting point of the full stroke. At full fluid pressure, this full stroke occurs every time fluid communication is opened between the first fluid input 18 and the first fluid output (Fig.3).

Accordingly, instead of orienting the piston 52 normal to the center axis of the drive cylinder 48 in the starting position and pivoting the piston 52 through a large angle as the swing arm 66 rotates through its cycle, the piston 52 is oriented two degrees from normal to start. In this way the piston 52 starts at a position two degrees from normal, cycles through a normal position, a position two degrees from normal in the opposite direction, another normal position, and finally a position two degrees from normal in the same direction as the starting position. The total amount of deviation from the normal position is thereby kept to a minimum throughout the full stroke.

Although the variable stroke motor 10 is fully capable of cycling through the full stroke noted above, this full stroke is only realized under full fluid pressure. When only a small amount of pressure is being applied to the first fluid input 18, the piston 52 moves through a much shorter stroke cycle. As the pressure of the fluid supplied by the fluid pressure generator 82 increases, a larger amount of fluid passes from the first fluid input 18, through the first fluid output 20 and into the drive cylinder 48 with each rotation of the valve shaft 16. This larger amount of fluid entering the drive cylinder 48 moves the piston 52 more quickly, thereby generating a longer and longer stroke. The swing arm 66 translates this longer stroke into a greater rotation of the drive shaft 80. Since the shaft rotator 42 rotates the valve shaft 16 at a constant speed, each cycle takes the same amount of time, regardless of the pressure of the fluid being applied. Accordingly, a greater rotation of the drive shaft 80 in the same amount of time translates into a greater speed of the drive shaft 80.

For each rotation of the valve shaft 16, the second slot 28 provided on the valve shaft 16 opens fluid communication between the second fluid input 22 and second fluid output 24 one time (FIG. 1). During this period of time, the force of the recovery spring 96 causes the swing arm 66 to push the piston rod 60 into the piston 52, thereby pushing fluid out of the drive cylinder 48 through the second fluid input 22 and second fluid out 24. The fluid is thereafter returned to the fluid pressure generator 82 through the supplemental transfer hose 86, so that the fluid can again be pressurized and recirculated through the motor 10 (FIG. 2). As the piston 52 is being driven, the supplemental valve and piston assembly 88 is working in a reciprocating manner, to drive the drive shaft 80 when the piston 52 is in its recovery stroke. As noted above, the anti-backlash sprag 116 prevents the swing arms 66 and 100 from transferring rotational energy to the drive shaft 80 during their recovery stroke.

Since the valve shaft 16 is rotated at a constant speed, varying the amount of fluid pressure entering the first fluid input 18 causes the piston 52 to stroke a longer distance, and thereby drive the drive shaft 80 a greater distance during the same interval. The fluid pressure generator 82 may be provided with a heating adjustment control 150, such as a propane valve, to vary the amount of heat delivered to the fluid pressure generator 82 and, thereby, the pressure of the fluid. Accordingly, the variable stroke motor 10 can directly convert a larger amount of heat energy into a faster rotation of the drive shaft 80.

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention. For example, it is anticipated that any number of supplemental valve and piston assemblies may be coupled to the drive shaft 80, and that a wide variety of dimensions are available for the fluid inputs and fluid outputs of the valve housing and for the slots in the valve shaft.

What is claimed is:

1. A drive shaft assembly comprising:

(a) a housing;

(b) a drive shaft;

(c) a first overrunning clutch assembly comprising:

(i) a first inner race having a first outer annular contact surface;

(ii) a first outer race having a first inner annular contact surface spaced radially from said first inner race, said first inner annular contact surface and said first outer annular contact surface forming a first annular space therebetween;

(iii) a first plurality of sprags provided in said first annular space, said first plurality of sprags being of a construction and placement capable of allowing said first inner race to rotate in a first direction relative to said first outer race, while preventing said first inner race from rotating in a second direction relative to said first outer race;

(iv) first sprag retainer means for maintaining said first plurality of sprags in said first annular space;

(d) wherein said housing is secured to said first outer race;

(e) wherein said drive shaft is secured to said first inner race;

(f) further comprising means coupled to said drive shaft for driving said drive shaft;

(g) wherein said driving means is coupled to said drive shaft by a second overrunning clutch comprising:

(i) a second inner race having a second outer annular contact surface;

(ii) a second outer race having a second annular contact surface spaced radially from said second inner race, said second inner annular contact surface and said second outer annular contact surface forming a second annular space therebetween;

(iii) a second plurality of sprags provided in said second annular space, said second plurality of sprags being of a construction and placement capable of allowing said second inner race to rotate in a first direction relative to said second outer race, while preventing said second inner race from rotating in a second direction relative to said second outer race;

(iv) second drive sprag retainer means for maintaining said second plurality of sprags in said second annular space;

(v) wherein said second overrunning clutch is coupled to said drive shaft in a manner which transfers rotational motion of said driving means to said drive shaft through said second overrunning clutch; and (h) wherein said first overrunning clutch and said second overrunning clutch are secured to said drive shaft in overrunning orientations opposite from one another.

2. The drive shaft assembly of claim 1, wherein said driving means comprises a swing arm.

3. The drive shaft assembly of claim 2, wherein said swing arm is pivotally coupled to a piston.

4. The drive shaft assembly of claim 3, further comprising means for reciprocating said piston.

5. The drive shaft assembly of claim 4, wherein said reciprocating means comprises:

(a) a valve housing forming;

(i) a hollow cylinder;

(ii) a first fluid input in fluid communication with said hollow cylinder;

(iii) a first fluid output in fluid communication with said hollow cylinder;

(iv) a second fluid input in fluid communication with said hollow cylinder;

(v) a second fluid output in fluid communication with said hollow cylinder;

(b) a valve shaft positioned within said hollow cylinder, said valve shaft being rotatable between a first position substantially sealing off fluid communication between said first fluid input and said first fluid output, and a second position substantially sealing off fluid communication between said second fluid input and said second fluid output;

(c) wherein said valve shaft is provided with a first slot and a second slot;

(d) wherein said first slot is oriented on said valve shaft in a manner which opens fluid communication between said second fluid input and said second fluid output when said valve shaft is in said first position;

(e) wherein said second slot is oriented on said valve shaft in a manner which opens fluid communication between said first fluid input and said first fluid output when said valve shaft is in said second position; and (f) means coupled to said valve shaft rotating said valve shaft between said first position and said second position.

6. The drive shaft assembly of claim 5, further comprising means for biasing said piston to push fluid out of said drive cylinder.

7. The drive shaft assembly of claim 6, wherein said biasing means is a spring.

8. An anti-backlash drive apparatus for a drive shaft comprising:

(a) a variable stroke motor having:

(1) a drive cylinder including:

a. a piston;

b. a piston rod connected at one end to said piston; and c. a swing arm connected to the opposite end of said piston rod;

(2) valve means for providing fluid at desired intervals to said drive cylinder to drive said piston in one direction in a drive stroke;

(3) bias means for urging said piston in a direction opposite to said one direction in a recovery stroke;

(b) a drive sprag assembly coupled to said drive shaft and said swing arm to transfer rotational energy from said drive cylinder to the drive shaft on the drive stroke of said piston and allow the shaft to freewheel relative to the swing arm on the recovery stroke; and (c) an anti-backlash sprag assembly secured to said drive shaft in an opposite operational orientation to said drive sprag assembly to prevent rotation of the drive shaft during said recovery stroke in a direction opposite to the direction it is driven during the drive stroke.

* * * * *